US006077395A

United States Patent [19]

Lehleiter et al.

[11] Patent Number: 6,077,395

[45] Date of Patent: Jun. 20, 2000

[54] HEAD BOX OF PAPER MACHINE

[75] Inventors: Klaus Lehleiter, Mengen; Hans Loser, Langenau; Wolfgang Ruf, Herbrechtingen-Bolheim, all of Germany

[73] Assignee: Voith Sulzer Papiermaschinen GmbH, Heidenheim, Germany

[21] Appl. No.: 09/023,789

[22] Filed: Feb. 13, 1998

[30] Foreign Application Priority Data

Feb. 14, 1997 [DE] Germany ..... 197 05 590

[51] Int. Cl.[7] ..... D21F 1/00

[52] U.S. Cl. ..... 162/216; 162/252; 162/259; 162/258; 162/343; 162/336

[58] Field of Search ..... 162/199, 212, 162/216, 336, 343, 252, 259, 258, 338, 339, 341

[56] References Cited

U.S. PATENT DOCUMENTS

| | | | |
|---|---|---|---|
| 5,490,905 | 2/1996 | Huovila et al. | 162/212 |
| 5,603,807 | 2/1997 | Heinzmann . | |
| 5,674,363 | 10/1997 | Huovila et al. | 162/216 |
| 5,695,611 | 12/1997 | Bubik et al. . | |

FOREIGN PATENT DOCUMENTS

| | | |
|---|---|---|
| 4019593 | 1/1992 | Germany . |
| 4239644 | 6/1994 | Germany . |
| 4320243 | 12/1994 | Germany . |
| 4437180 | 3/1995 | Germany . |
| 4430895 | 3/1996 | Germany . |

OTHER PUBLICATIONS

Copy of a German Search Report dated Jun. 20, 1997 conducted in German Patent Application No. 197 05 590.7.

*Primary Examiner*—Stanley S. Silverman
*Assistant Examiner*—Robert McBride
*Attorney, Agent, or Firm*—Greenblum & Bernstein, P.L.C.

[57] ABSTRACT

Head box for manufacturing a fibrous pulp web. The head box may include a pulp suspension inlet feed device that is sectioned across a width of the head box that feeds a pulp suspension in a feed direction, at least one device having a plurality of entrance ports that produces microturbulences, and an intermediate channel extending across the width of the head box and positioned in front of the at least one device. A plurality of partition units being positionably adjustable into the intermediate channel and being arranged parallel to the feed direction.

21 Claims, 5 Drawing Sheets

HEAD BOX OF PAPER MACHINE

CROSS-REFERENCE TO RELATED APPLICATION

The present application claims priority under 35 U.S.C. § 119 of German Patent Application No. 197 05 590.7, filed on Feb. 14, 1997, the disclosure of which is expressly incorporated by reference herein in its entirety.

BACKGROUND OF THE INVENTION

1. Field of the Invention

The present invention relates to a head box for manufacturing a fibrous pulp web, e.g., a paper web, in which the head box includes a sectioned pulp suspension inlet feed device, a microturbulence device, and an intermediate channel. The head box also includes a plurality of positionally adjustable partitions that extend into the intermediate channel. The head box of the present invention may also include a device for controlling the effective width of a sectioned fluid flow.

2. Background and Material Information

In general, a head box should, at the latest in front of an outlet, regulate pulp consistency and a fiber orientation cross-sectional profile of a paper pulp suspension. In this manner, the surface weight and fiber orientation cross-sectional profile of the paper web correspond to desired specifications across an entire width and generally remain constant.

Accordingly, a modern head box is equipped with sectioned fluid supply lines, which make it possible to individually supply each section in the head box, to control consistency of pulp flow, and, thereby a web thickness in this section, and/or to create cross-flows in the head box by sectionally feeding the pulp suspension. In this manner, control of fiber orientation cross-sectional profile of the produced web may be achieved.

An example of such a head box has been discussed in German Patent Application 40 19 593 A1. This known head box includes a pulp feed inlet that is sectioned across the width of the machine. In this manner, the composition of the suspension and/or the throughput can be individually adjusted in the individual sections. This head box also includes an intermediate channel with one or two subsequently arranged eddy-inserts, an intermediate chamber located between the intermediate channel and the eddy-inserts, if necessary, and a discharge nozzle.

A disadvantageous of this type of head box is that the intermediate chambers are necessary and that these intermediate chambers cause an overlapping of changes in one section and in neighboring sections. As a result, the effective width of the sectional alternations cannot be controlled.

SUMMARY OF THE INVENTION

The present invention provides a head box having a sectioned fluid feed system. In this manner, an effective width of sectional alterations may be controlled in the fluid feed system. The present invention also describes a process for controlling flow in a head box that results in the same effect.

In accordance with the above, a head box, similar in general to those utilized in the prior art, is provided for manufacturing a fibrous pulp web, e.g., a paper web, in a web production machine. The head box may include a pulp suspension feed system that is sectioned across a width of the machine, at least one eddy-insert having a plurality of inlet openings, an intermediate channel extending across the width of the machine and positioned in front of the eddy-insert, in the pulp suspension feed direction, and a discharge nozzle that extends across the width of the machine. The intermediate channel may include a plurality of positionally adjustable partition units arranged in the feed direction, the partition units being positionally adjustable lengthwise in the intermediate channel. Alternatively, the intermediate channel may include a plurality of positionally adjustable partition units arranged in the feed direction, the partition units being positionally adjustable in the intermediate channel lateral to the feed direction.

In both of the above-noted embodiments, it is possible to variably pattern a lateral effect of a change created upstream to a sectioned suspension flow with respect to a composition and/or an amount of throughput. In accordance with the features of the present invention, lengthwise extension of the partition units into the intermediate channel may result in a reduction of a free cross-section of the intermediate channel in which the mixing between the sectional divisions of the head box occurs and of an effective width of an alteration reaching the head box nozzle. In accordance with another feature of the present invention, lateral displacement of the plurality of partition units within the intermediate channel can control an effective width. In this manner, the width of control of an upstream alteration is restricted directly by the internal distance between two partition units.

The head box can be designed so that the partition units can be, e.g, at least partially slid in or slid out of one of the upstream and downstream partition units of the intermediate channel, or designed so that the partition units can, e.g., slide in and out of the base plate or cover plate of the intermediate channel. Alternatively, or in addition to the above-noted features, when the present invention is to be practiced in a spatially restrictive environment, the partition units may be formed as telescoping units that are adjustable in length.

In accordance with the present invention, the intermediate channel may include a lateral space in which one or more partition units can be parked, e.g., in a home/rest position. In this manner, it is not necessary that all available partition units have to be inserted simultaneously.

The partition units may be advantageously formed to extend across the entire length of the intermediate channel, over only a part of the channel length, or over a combination of both.

Further, in accordance with the present invention, at least some of the partition units are individually positionally adjustable, e.g., transversely and/or in the feed direction.

According to the features of the present invention, at least some of the partition units may be rotatably mounted around an axis that is perpendicular to the feed direction.

Another advantageous embodiment of the present invention may be provided by forming the individual partition units so that their position and location can be adjusted. In this manner, the machine may react as precisely as possible to production errors during the manufacturing of paper.

The present invention is directed to a head box for manufacturing a fibrous pulp web. The head box may include a pulp suspension inlet feed device that is sectioned across a width of the head box that feeds a pulp suspension in a feed direction, at least one device having a plurality of entrance ports that produces microturbulences, and an intermediate channel extending across the width of the head box and positioned in front of the at least one device. A plurality of partition units may be positionably adjustable into the intermediate channel and may be arranged parallel to the feed direction.

In accordance with another feature of the present invention, the head box further includes a partitioned wall located on an upstream side of the intermediate channel. The partition units may be coupled to the partitioned wall to slide in and out the partitioned wall.

In accordance with another feature of the present invention, the head box further includes a partitioned wall located on an downstream side of the intermediate channel. The partition units may be coupled to the partitioned wall to slide in and out the partitioned wall.

In accordance with still another feature of the present invention, the intermediate channel may include a base and top plate for receiving the sliding partition units.

In accordance with a further feature of the present invention, the partition units may include length-adjustable telescoping walls.

In accordance with a still further feature of the present invention, distances that the partition units extend into the intermediate channel are individually adjustable.

In accordance with another feature of the present invention, the head box may further include a discharge nozzle extending across the width of the head box and coupled to the eddy-insert. Further, the fibrous pulp web may include a paper web.

The present invention is also directed to a head box for manufacturing a fibrous pulp web that includes a pulp suspension feed device that is sectioned across a width of the head box, at least one eddy-insert, having a plurality of entrance ports, that produces microturbulences, and an intermediate channel, extending across the width of the head box, coupled to the eddy insert. A plurality of partition units may be adjustably positioned in the intermediate channel in a suspension feed direction.

In accordance with another feature of the present invention, the intermediate channel may include a lateral space for storing partition units not sectioning the intermediate channel.

In accordance with another feature of the present invention, at least some of the plurality of partition units may extend over an entire length of the intermediate channel.

In accordance with a further feature of the present invention, at least some of the plurality of partition units may be individually positionally adjustable in a direction transverse to the suspension feed direction.

In accordance with a still further feature of the present invention, at least some of the plurality of partition units may have a length less than a length of the intermediate channel. The partition units may have a length less than the intermediate channel being positionally adjustable in the suspension feed direction.

In accordance with still another feature of the present invention, at least some of the plurality of partition units may be rotatably mounted for rotation around an axis perpendicular to the suspension feed direction.

In accordance with a further feature of the present invention, the head box may include a discharge nozzle extending across the width of the head box and coupled to the eddy-insert. Further, the fibrous pulp web may include a paper web.

The present invention is directed to a process of controlling an output of a head box for manufacturing a fibrous pulp web. The head box is composed of an intermediate channel having a plurality of partition walls and is positioned between a plurality of outlets of a pulp suspension inlet feed device and a plurality of inlets of a microturbulence device. The process includes directing a pulp suspension feed, in a feed direction, into the intermediate channel through the plurality of pulp suspension inlet feed device outlets and adjustably moving at least one of the plurality of partition walls in the intermediate channel to selectively couple some of the plurality of pulp suspension inlet feed device outlets to some of the plurality of inlets of the microturbulence device.

In accordance with another feature of the present invention, the process may further include positioning the plurality of partition walls for translational movement into and out of recesses between the plurality of pulp suspension inlet feed device outlets. The adjustable moving of at least one of the plurality of partition walls may include translationally moving the at least one of the plurality of partition walls in a direction parallel to the feed direction. Further, the process may include angularly moving the at least one of the plurality of partition walls in a direction substantially transverse to the feed direction.

In accordance with still another feature of the present invention, the process may further include positioning the plurality of partition walls for translational movement into and out of recesses between the inlets of the microturbulence device. The adjustable moving of at least one of the plurality of partition walls may include translationally moving the at least one of the plurality of partition walls in a direction parallel to the feed direction.

In accordance with a further feature of the present invention, the process may include positioning the plurality of partition walls for translational movement in the intermediate channel. The adjustable moving of at least one of the plurality of partition walls may include translationally moving the at least one of the plurality of partition walls in a direction transverse to the feed direction. Further, the process may include storing some of the plurality of partition walls in a recess adjacent the intermediate channel.

The present invention is directed to a head box for manufacturing a fibrous pulp web that includes a pulp suspension feed device having a plurality of outlets arranged across a width of the head box feeding a pulp suspension in a feed direction, at least one eddy-insert having a plurality of inlet ports, and an intermediate channel coupled between the plurality of outlets of the pulp suspension feed device and the plurality of inlets of the eddy insert. A plurality of partition units are adjustably positionable in the intermediate channel to selectively couple some of the plurality of outlets of the pulp suspension feed device with some of the plurality of inlets of the eddy insert.

In accordance with another feature of the present invention, the head box further includes separating walls having recesses being positioned between adjacent outlets of the pulp suspension feed. Further, the plurality of partition walls may be positionable within the recesses of the separating walls and at least one of the plurality of partition walls may be movable within the one recess to be positioned between fully enclosed within the separating wall and extended across an entire width of the intermediate channel.

In accordance with still another feature of the present invention, the plurality of partition walls may be positionable within the recesses of the separating walls and at least one of the plurality of partition walls may be movable within the one recess to be positioned between fully enclosed within the separating wall and extended into the intermediate channel. Further, the at least one partition wall may include a rotational axis enabling angular rotation of the at least one partition wall in a direction substantially transverse to the feed direction.

In accordance with a further feature of the present invention, the head box may include separating walls having recesses being positioned between adjacent inlets of the eddy-insert. Further, the plurality of partition walls may be positionable within the recesses of the eddy-insert and at least one of the plurality of partition walls may be movable within the one recess to be positioned between fully enclosed within the separating wall and extended across an entire width of the intermediate channel.

In accordance with another feature of the present invention, the plurality of partition walls may be adjustably positioned within the intermediate channel to form discrete openings between the outlets of the pulp suspension feed device and the inlets of the eddy-insert. The plurality of partition walls may be movable in a direction transverse to the feed direction. Further, a recess may be formed adjacent the intermediate channel to store at least one of the plurality of partition walls.

In accordance with yet another feature of the present invention, the head box may include a recess formed adjacent the intermediate channel to store at least one of the plurality of partition walls.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
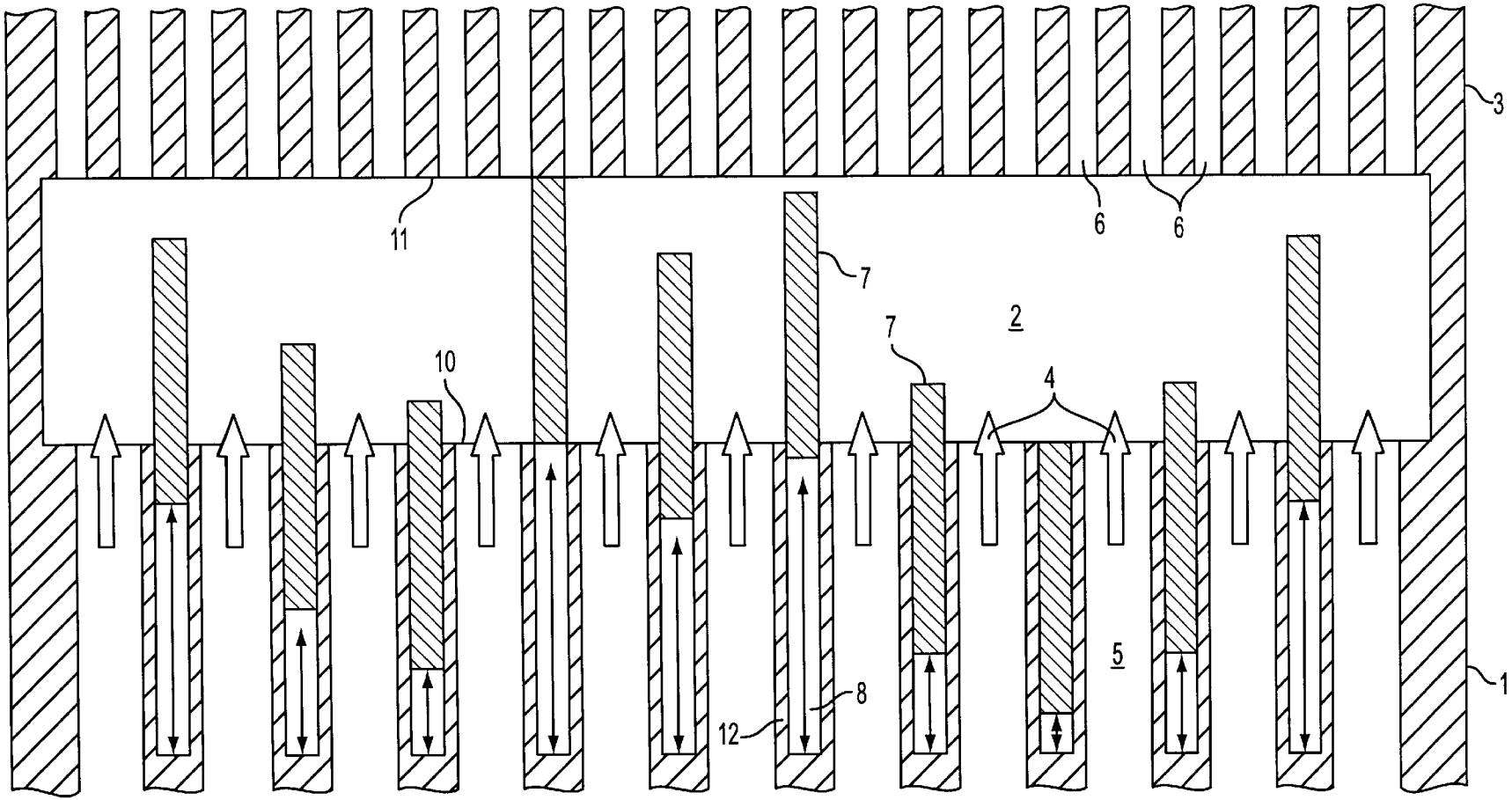
FIG. 1 illustrates a cross-section through a head box in a pulp feed inlet/eddy-insert region having displaceable partition units that can be slid in a feed direction and are located on an upstream side of the intermediate channel.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

FIG. 1 schematically depicts a cross-section through a transition region of a head box. The transition region extends from a pulp feed inlet 1 over an intermediate channel 2 to an eddy-insert 3. Pulp feed inlet 1 may be sectioned to provide a plurality of sectioned flows 4, which are individually controlled by channels 5, into intermediate chamber 2, and then to eddy-insert 3. The plurality of sectioned flows 4 establish a feed direction for the head box. Eddy-insert 3 may be formed by a plurality of bundled pipes 6 and channels 5 may be formed by walls 12 of pulp feed inlet 1. Slots 8 may be formed within walls 12 of pulp inlet feed 1, e.g., on an upstream side 10 of intermediate channel 2. Partition units 7 may be movably mounted for lengthwise movement or adjustability within respective slots (recesses) 8. In this manner, partition units 7 may be selectively, and preferably independently, extended and retracted into slots 8, and more particularly, extended and retracted into intermediate channel 2, if and when the need arises.

When all partition units 7 are completely extended, a complete separation of sectioned flows 4 occurs within intermediate channel 2. As a result, a complete prevention of alternation overlapping effects between neighboring sectioned flows is provided. Conversely, a complete retraction of partition units 7 into slots 8 opens the entire width of intermediate channel 2, thus, enabling maximum overlap between neighboring sectioned flows. When partition units 7 are positioned to lie somewhere between the fully extended and the fully retracted position, a well-directed adjustment of the effective width is provided due to changes in one section to the neighboring section.

Figure 2:
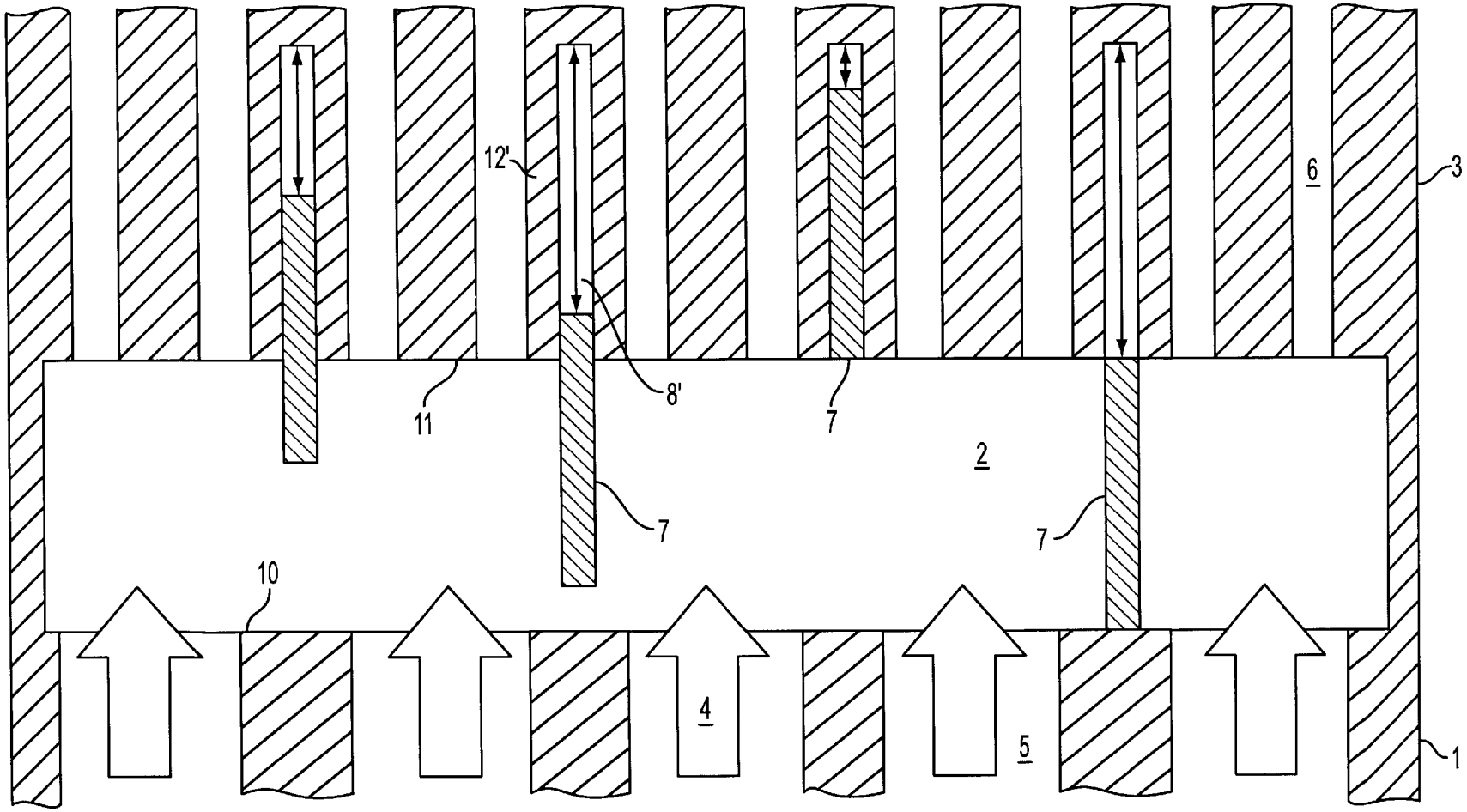
FIG. 2 illustrates a cross-section through a head box in the pulp feed inlet/eddy-insert region having slidable partition units that can slide in the feed direction and are located on a downstream side of the intermediate channel.

FIG. 2 illustrates an alternative to the embodiment depicted in FIG. 1 in that the walls 12' and slots 8' for partition units 7' are arranged on a downstream side 11 of intermediate channel 2, i.e., in eddy-insert 3. Because the effect that neighboring volume flows have one each other increases in the feed direction, this embodiment has the advantage that by using partition units 7' that extend equally as far into the intermediate channel as in the embodiment depicted in FIG. 1, a greater separation may be attained than in the FIG. 1 embodiment.

Figure 3:
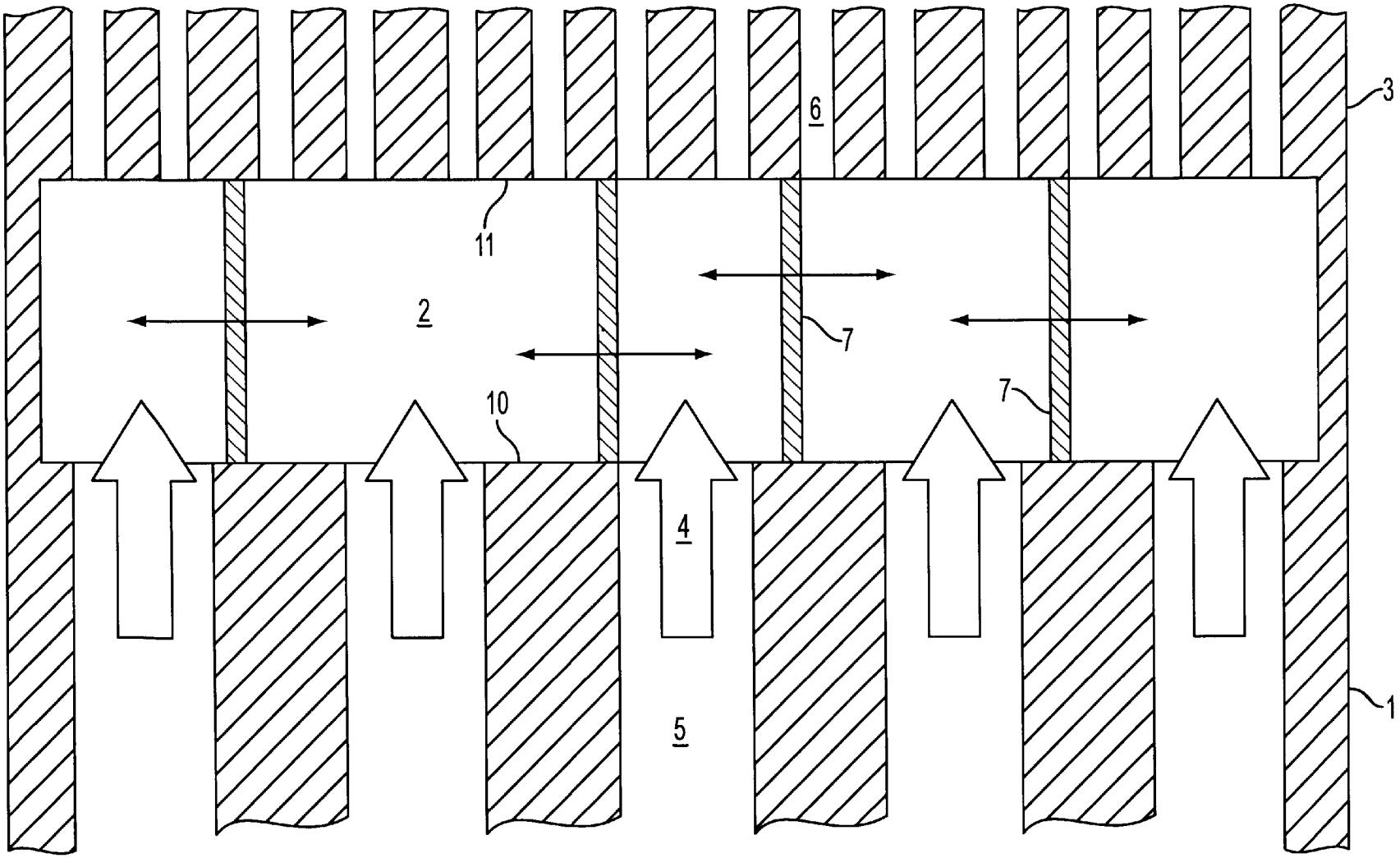
FIGS. 3 and 4 illustrate a cross-section through two embodiments of a head box in the pulp feed inlet/eddy-insert region having laterally movable partition units that can slide laterally to the feed direction in the intermediate channel.
Figure 4:
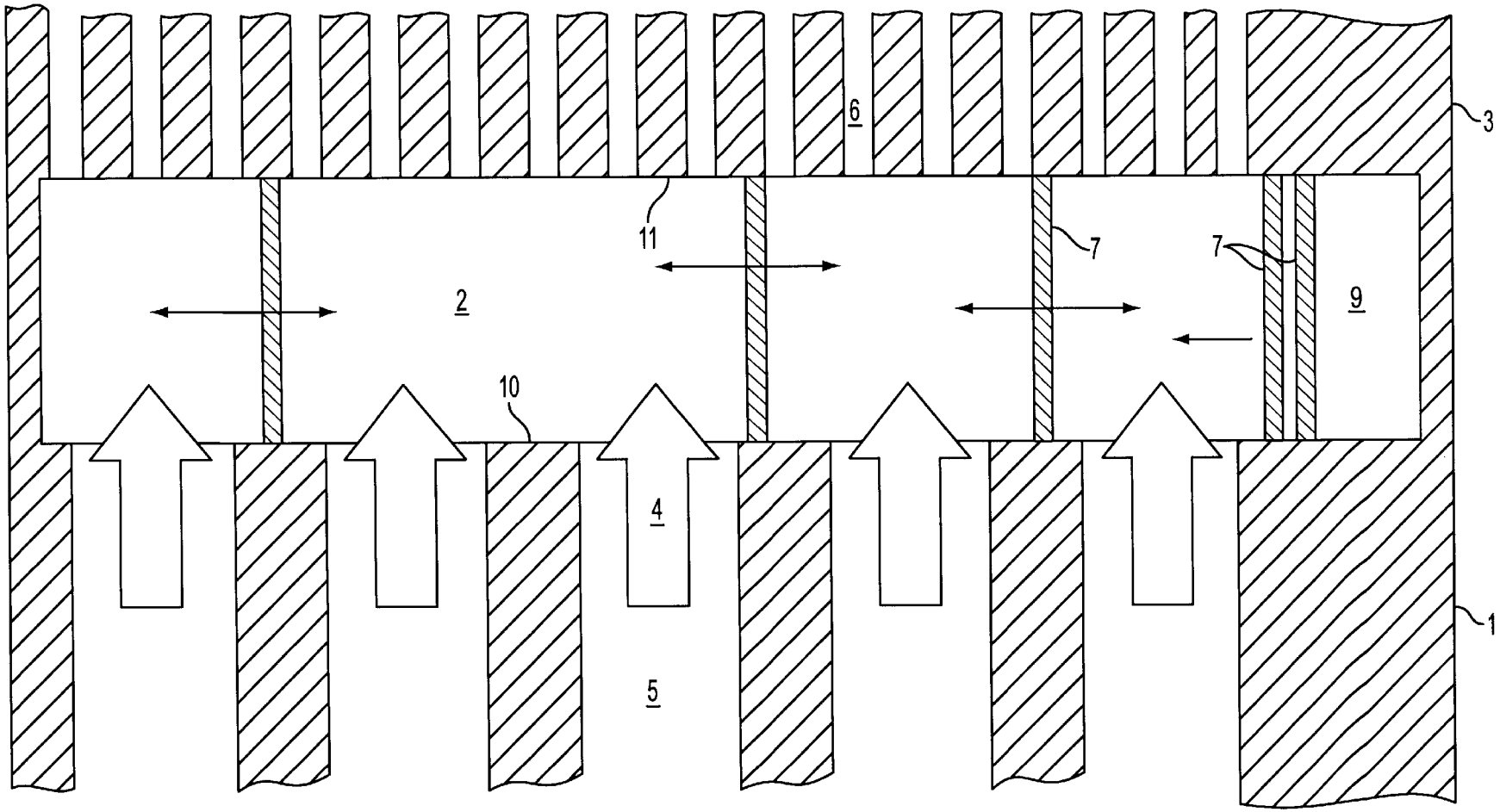

FIGS. 3 and 4 illustrate another embodiment of the present invention in which partition units 7 are positionably mounted in intermediate channel 2 of the head box. In particular, partition units 7 may be mounted to slide freely for movement transverse to the feed direction. By sliding partition units 7, one or more of sectioned flows may be sealed off or isolated from neighboring flows, so that an overlapping of neighboring sectioned suspension flows 4 outside of the respective partition units 7 is substantially prevented. Further, by laterally adjusting the respective area within the intermediate chamber, the specific flow to the eddy-insert 3 may be adjusted. That is, positioning of partition units 7 enable flow velocity to be controlled. In this manner, the fiber orientation cross-sectional profile may be controlled via adjustment of the channel width. By adjusting partition unit 7, channel distribution may be adjusted so that a feed channel 5 may selectively feeds a variable number of eddy-insert pipes 6, which may result in considerable changes in the flow velocity.

FIG. 4 illustrates that by laterally adjusting partition units 7 to join flows 4 of adjacent channels 5, non-utilized partition units may be positioned within intermediate channel 2. Accordingly, intermediate channel 2 may include an idle chamber 9 in which partition units 7 which are not currently in use may be stored or parked for later use. It is preferred that idle chamber 9 is of a size sufficient to store all of the partition units 7 as one time, in the event that the entire width of the intermediate channel 2 is to be opened up entirely. Accordingly, the intermediate channel 2 may be equally able to operate with none, all, or only some of the partition units 7 in place within intermediate channel 2.

Figure 5:
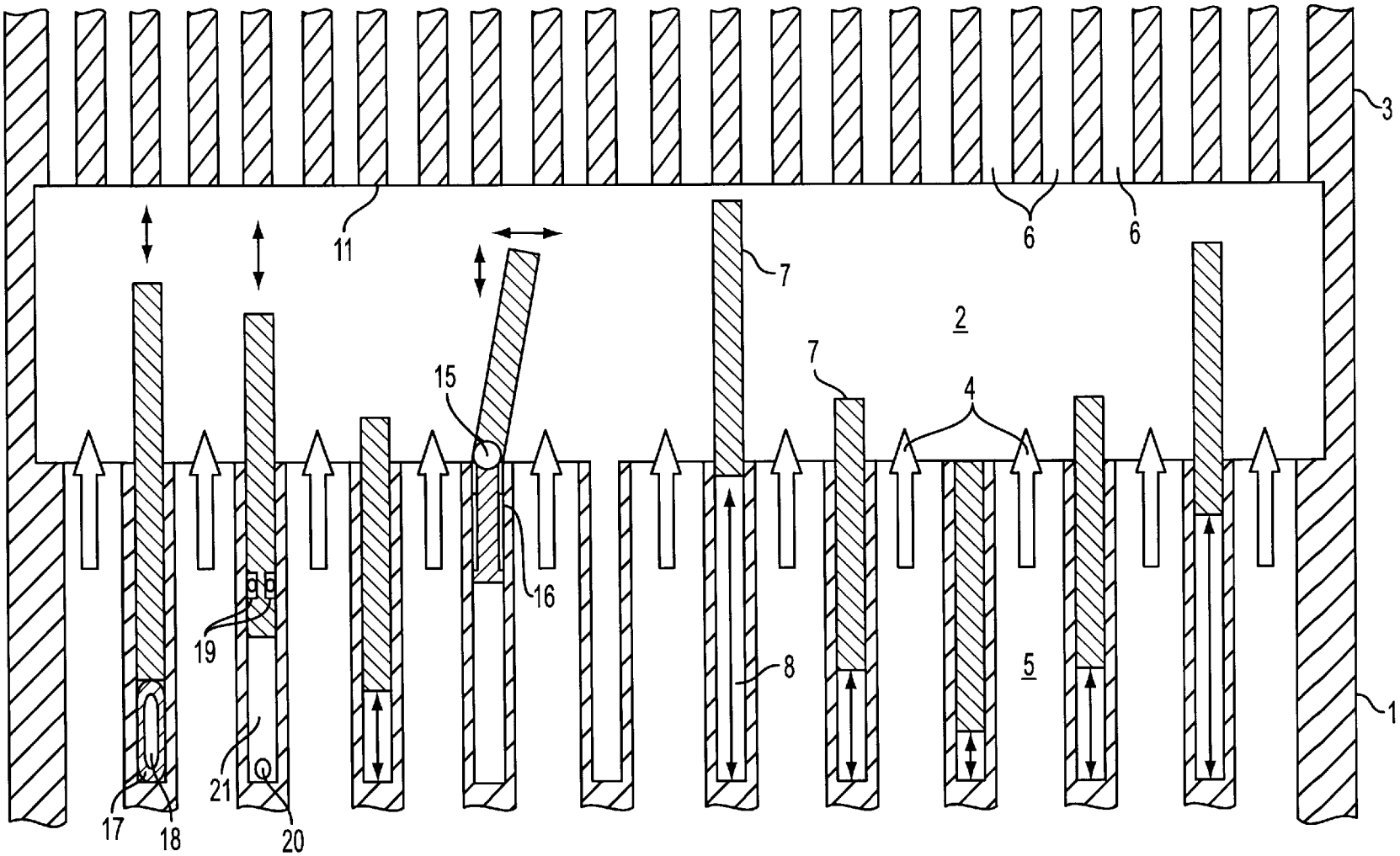
FIG. 5 illustrates a cross-section through a head box in a pulp feed inlet/eddy-insert region having slidable partition units and partition units having a pivot for angular movement in a direction substantially transverse to the feed direction.

FIG. 5 illustrates a further embodiment of the present invention in which the partition units 7 are mounted for translational movement in the feed direction and provided with a pivot 15 that enables partition unit 7, once extended to a desired length, to be angularly adjustable in a direction substantially transverse to the feed direction. Recesses 8 may be provided with limit stops 16 to inhibit further extension of partition unit 7 into intermediate channel 2.

It is noted that the adjustment of partition units 7 may occur either prior to operation or during operation of the head box. In this regard, it is noted that to facilitate adjustment of partition unit 7, a flexible hose 17 may be positioned within recess 8. Via an application of a variable pressure 18 into flexible hose 17, partition unit 7 may be translationally moved into or out of intermediate channel 2. Alternatively, partition unit 7 and recess 8 may be formed in a piston/cylinder arrangement. That is, partition unit 7 may be provided with seals 19 and recess 8 may be formed as a pressure chamber 21 to receive a pressurized fluid, e.g., oil, gas, air, water, via an inlet 20. The pressure imparted within pressure chamber 21 is utilized to position partition unit 7 within intermediate channel 2 or separating wall 12. Further, the present invention contemplates various combinations of the positionably adjustable partition units within a single head box, i.e., to exhibit movement parallel to and/or transverse to the feed direction, and/or with angular movement substantially transverse to the feed direction.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A head box for manufacturing a fibrous pulp web comprising:

a pulp suspension inlet feed device that is sectioned across a width of the head box that feeds a pulp suspension in a feed direction;

at least one device having a plurality of entrance ports that produces microturbulences;

an intermediate channel extending across the width of the head box and positioned in front of the at least one device; and a plurality of partition units positionably adjustable into the intermediate channel and arranged parallel to the feed direction;

a partitioned wall located on an upstream side of the intermediate channel;

the partition units being coupled to the partitioned wall to slide into and out of the partitioned wall.

2. The head box in accordance with claim 1, the intermediate channel including a base and top plate for receiving the sliding partition units.

3. The head box in accordance with claim 1, wherein the distances that the partition units extend into the intermediate channel are individually adjustable.

4. The head box in accordance with claim 1, further comprising a discharge nozzle extending across the width of the head box and coupled to the at least one device.

5. The head box in accordance with claim 1, the fibrous pulp web comprising a paper web.

6. A head box for manufacturing a fibrous pulp web comprising:

a pulp suspension inlet feed device that is sectioned across a width of the head box that feeds a pulp suspension in a feed direction;

at least one device having a plurality of entrance ports that produces microturbulences;

an intermediate channel extending across the width of the head box and positioned in front of the at least one device; and a plurality of partition units positionably adjustable into the intermediate channel and arranged parallel to the feed direction;

a partitioned wall located on a downstream side of the intermediate channel;

the partition units being coupled to the partitioned wall to slide into and out of the partitioned wall.

7. A head box for manufacturing a fibrous pulp web comprising:

a pulp suspension inlet feed device that is sectioned across a width of the head box that feeds a pulp suspension in a feed direction;

at least one device having a plurality of entrance ports that produces microturbulences;

an intermediate channel extending across the width of the head box and positioned in front of the at least one device; and a plurality of partition units positionably adjustable into the intermediate channel and arranged parallel to the feed direction;

the partition units comprising length-adjustable telescoping walls.

8. A head box for manufacturing a fibrous pulp web comprising:

a pulp suspension feed device that is sectioned across a width of the head box;

at least one eddy-insert that produces microturbulences, the eddy-insert having a plurality of entrance ports;

an intermediate channel, extending across the width of the head box, coupled to the eddy-insert;

a plurality of partition units adjustable positioned in the intermediate channel in a suspension feed direction;

at least some of the plurality of partition units have a length less than a length of the intermediate channel;

the partition units having a length less than the intermediate channel being positionally adjustable in the suspension feed direction.

9. The head box in accordance with claim 8, the intermediate channel comprising a lateral space for storing partition units not sectioning the intermediate channel.

10. The head box in accordance with claim 8, at least some of the plurality of partition units being rotatably mounted for rotation around an axis perpendicular to the suspension feed direction.

11. The head box in accordance with claim 8, further comprising a discharge nozzle extending across the width of the head box and coupled to the eddy-insert.

12. The head box in accordance with claim 8, the fibrous pulp web comprising a paper web.

13. A process of controlling an output of a head box for manufacturing a fibrous pulp web, the head box being composed of an intermediate channel having a plurality of partition walls and being positioned between a plurality of outlets of a pulp suspension inlet feed device and a plurality of inlets of a microturbulence device, the process comprising:

directing a pulp suspension feed, in a feed direction, into the intermediate channel through the plurality of pulp suspension inlet feed device outlets;

adjustably moving at least one of the plurality of partition walls in the intermediate channel to selectively couple some of the plurality of pulp suspension inlet feed device outlets to some of the plurality of inlets of the microturbulence device;

positioning the plurality of partition walls for translational movement into and out of recesses between the plurality of pulp suspension inlet feed device outlets; and the adjustable moving of at least one of the plurality of partition walls comprising:

translationally moving the at least one of the plurality of partition walls in a direction parallel to the feed direction.

14. The process in accordance with claim 13, further comprising:

angularly moving the at least one of the plurality of partition walls in a direction substantially transverse to the feed direction.

15. A process of controlling an output of a head box for manufacturing a fibrous pulp web, the head box being composed of an intermediate channel having a plurality of partition walls and being positioned between a plurality of outlets of a pulp suspension inlet feed device and a plurality of inlets of a microturbulence device, the process comprising:

directing a pulp suspension feed, in a feed direction, into the intermediate channel through the plurality of pulp suspension inlet feed device outlets;

adjustably moving at least one of the plurality of partition walls in the intermediate channel to selectively couple some of the plurality of pulp suspension inlet feed device outlets to some of the plurality of inlets of the microturbulence device;

positioning the plurality of partition walls for translational movement into and out of recesses between the inlets of the microturbulence device; and the adjustable moving of at least one of the plurality of partition walls comprising:

translationally moving the at least one of the plurality of partition walls in a direction parallel to the feed direction.

16. A head box for manufacturing a fibrous pulp web comprising:

a pulp suspension feed device having a plurality of outlets arranged across a width of the head box feeding a pulp suspension in a feed direction;

at least one eddy-insert having a plurality of inlet ports;

an intermediate channel coupled between the plurality of outlets of the pulp suspension feed device and the plurality of inlets of the eddy-insert;

a plurality of partition units adjustable positionable in the intermediate channel to selectively couple some of the plurality of outlets of the pulp suspension feed device with some of the plurality of inlets of the eddy-insert;

separating walls having recesses being positioned between adjacent outlets of the pulp suspension feed;

the plurality of partition walls being positionable within the recesses of the separating walls; and at least one of the plurality of partition walls being movable within the one recess to be positioned between fully enclosed within the separating wall and extended across an entire width of the intermediate channel.

17. A head box for manufacturing a fibrous pulp web comprising:

a pulp suspension feed device having a plurality of outlets arranged across a width of the head box feeding a pulp suspension in a feed direction;

at least one eddy-insert having a plurality of inlet ports;

an intermediate channel coupled between the plurality of outlets of the pulp suspension feed device and the plurality of inlets of the eddy-insert;

a plurality of partition units adjustable positionable in the intermediate channel to selectively couple some of the plurality of outlets of the pulp suspension feed device with some of the plurality of inlets of the eddy-insert;

separating walls having recesses being positioned between adjacent outlets of the pulp suspension feed;

the plurality of partition walls being positionable within the recesses of the separating walls; and at least one of the plurality of partition walls being movable within the one recess to be positioned between fully enclosed within the separating wall and extended into the intermediate channel.

18. The head box in accordance with claim 17, the at least one partition wall comprising a rotational axis enabling angular rotation of the at least one partition wall in a direction substantially transverse to the feed direction.

19. A head box for manufacturing a fibrous pulp web comprising:

a pulp suspension feed device having a plurality of outlets arranged across a width of the head box feeding a pulp suspension in a feed direction;

at least one eddy-insert having a plurality of inlet ports;

an intermediate channel coupled between the plurality of outlets of the pulp suspension feed device and the plurality of inlets of the eddy-insert;

a plurality of partition units adjustably positionable in the intermediate channel to selectively couple some of the plurality of outlets of the pulp suspension feed device with some of the plurality of inlets of the eddy-insert; and separating walls having recesses being positioned between adjacent inlets of the eddy-insert.

20. The head box in accordance with claim 19, the plurality of partition walls being positionable within the recesses of the eddy-insert; and at least one of the plurality of partition walls being movable within the one recess to be positioned between fully enclosed within the separating wall and extended across an entire width of the intermediate channel.

21. A head box for manufacturing a fibrous pulp web comprising:

a pulp suspension inlet feed device that is sectioned across a width of the head box that feeds a pulp suspension in a feed direction;

at least one device having a plurality of entrance ports that produces microturbulences;

an intermediate channel extending across the width of the head box and positioned in front of the at least one device; and a plurality of partition units positionably adjustable into the intermediate channel and arranged parallel to the feed direction;

a partitioned wall located on an, at least, upstream side or downstream side of the intermediate channel;

the partition units being coupled to the partitioned wall to slide in and out the partitioned wall;

the intermediate channel including a base and top plate for receiving the sliding partition units;

the partition units comprising length-adjustable telescoping walls;

at least one adjuster for individually adjusting distances that the partition units extend into the intermediate channel; and a discharge nozzle extending across the width of the head box and coupled to the at least one device.

* * * * *